US007721769B2

(12) United States Patent
Fernandes

(10) Patent No.: US 7,721,769 B2
(45) Date of Patent: May 25, 2010

(54) PAPER MACHINE FABRIC WITH TRAPEZOIDAL SHAPED FILAMENTS

(75) Inventor: Lippi A. Fernandes, Brummen (NL)

(73) Assignee: Voith Patent GmbH, Heidenheim (DE)

( * ) Notice: Subject to any disclaimer, the term of this patent is extended or adjusted under 35 U.S.C. 154(b) by 88 days.

(21) Appl. No.: 11/625,017

(22) Filed: Jan. 19, 2007

(65) Prior Publication Data

US 2008/0173369 A1 Jul. 24, 2008

(51) Int. Cl.

| | |
|---|---|
| ***D03D 13/00*** | (2006.01) |
| ***D03D 3/04*** | (2006.01) |
| ***D21F 7/08*** | (2006.01) |
| *D03D 25/00* | (2006.01) |

(52) U.S. Cl. ..... 139/383 A; 139/383 R; 139/383 AA; 162/358.2

(58) Field of Classification Search ..... 139/383 R, 139/383 A, 383 AA, 408, 411, 412, 413, 139/414; 162/348, 358.1, 358.2, 900, 902, 162/903, 904

See application file for complete search history.

(56) References Cited

U.S. PATENT DOCUMENTS

| | | | | |
|---|---|---|---|---|
| 3,573,164 | A | 3/1971 | Friedberg et al. | 162/348 |
| 3,858,623 | A * | 1/1975 | Lefkowitz | 139/425 A |
| 4,191,219 | A * | 3/1980 | Kaye | 139/383 R |
| 4,500,590 | A * | 2/1985 | Smith | 428/222 |
| 4,583,302 | A * | 4/1986 | Smith | 34/116 |
| 4,676,278 | A * | 6/1987 | Dutt | 139/383 AA |
| 4,696,852 | A * | 9/1987 | Lefferts | 428/222 |
| 5,211,815 | A * | 5/1993 | Ramasubramanian et al. | 162/348 |
| 5,407,737 | A | 4/1995 | Halterbeck et al. | 428/229 |
| 5,449,026 | A | 9/1995 | Lee | 139/383 |
| 5,597,450 | A * | 1/1997 | Baker et al. | 162/348 |
| 5,613,527 | A * | 3/1997 | Zimmermann et al. | 139/383 A |
| 2002/0079077 | A1 * | 6/2002 | Savela | 162/255 |
| 2002/0088593 | A1 * | 7/2002 | Mauretti | 162/348 |
| 2003/0084952 | A1 * | 5/2003 | Burazin et al. | 139/383 A |
| 2003/0084953 | A1 * | 5/2003 | Burazin et al. | 139/383 A |
| 2004/0261883 | A1 * | 12/2004 | Harrison | 139/383 A |
| 2005/0260409 | A1 * | 11/2005 | Payne et al. | 428/364 |
| 2006/0003655 | A1 | 1/2006 | Patel et al. | 442/207 |
| 2006/0070217 | A1 * | 4/2006 | Sayers | 28/104 |
| 2006/0075737 | A1 * | 4/2006 | Hay et al. | 57/206 |
| 2006/0085998 | A1 * | 4/2006 | Herman et al. | 34/453 |
| 2006/0162803 | A1 * | 7/2006 | Vines | 139/383 A |

FOREIGN PATENT DOCUMENTS

| | | | |
|---|---|---|---|
| DE | 4141139 | A1 | 6/1993 |
| DE | 102005041042 | A1 | 3/2007 |
| WO | WO 2004027144 | A1 * | 4/2004 |
| WO | 2004061168 | A1 | 7/2004 |

* cited by examiner

*Primary Examiner*—Bobby H Muromoto, Jr.
(74) *Attorney, Agent, or Firm*—Taylor & Aust, P.C.

(57) ABSTRACT

A fabric for use on a paper machine includes a plurality of filaments woven together. At least a portion of the filaments have a generally flat machine side base, a generally flat web side face, and a pair of generally flat side walls extending between the base and the face. The portion of the filaments having a generally trapezoidal shaped cross section is defined by the base, the face and the pair of side walls.

33 Claims, 2 Drawing Sheets

PAPER MACHINE FABRIC WITH TRAPEZOIDAL SHAPED FILAMENTS

BACKGROUND OF THE INVENTION

1. Field of the Invention

The present invention relates to fabrics for use in paper machines, and, more particularly, to fabrics used for moulding fiber webs.

2. Description of the Related Art

A paper machine typically includes a number of discrete sections along the running length of the machine, such as the fordrinier section, forming section, press section, and drying section. Each section of the paper machine typically includes a plurality of rolls and possibly other components which carry a corresponding fabric. A fabric typically has opposite ends which are joined together to define an endless fabric carried by the rolls, with the particular configuration of the fabric corresponding to the particular use in the paper machine.

One type of fabric is a through air dryer (TAD) fabric used to produce a tissue web. During production of such a tissue web using the TAD drying process, the tissue web is moulded inside the fabric structure, creating pillows that provide desired bulk and water absorption properties to the tissue web. At the end of the TAD process, the tissue web is removed from the fabric topography to be transported downstream in the machine direction (MD) of the paper machine. It is therefore desirable for the fabric to have good sheet release properties so that the tissue web can be successfully removed from the TAD fabric. The release properties of the fabric can be affected by the shape of the individual filaments in the fabric and chemical release agents applied to the fabric. The use of chemical release agents is minimized so as not to adversely affect the runability and production cost issues.

What is needed in the art is a fabric for TAD applications having better release properties than conventional fabrics.

SUMMARY OF THE INVENTION

The present invention provides a fabric for use on a paper machine, including at least some filaments having a trapezoidal shaped cross section.

The invention in one form is directed to a fabric for use on a paper machine, including a plurality of filaments woven together. At least a portion of the filaments have a machine side base, a web side face, and a pair of side walls extending between the base and the face. The portion of the filaments having a generally trapezoidal shaped cross section is defined by the face and the pair of side walls.

The invention in another form is directed to a fabric for use on a paper machine, including a plurality of filaments woven together. At least a portion of the filaments have a generally flat machine side base, a generally flat web side face, and a pair of generally flat side walls extending between the base and the face. The portion of the filaments having a generally trapezoidal shaped cross section is defined by the base, the face and the pair of side walls.

The invention in yet another form is directed to a paper machine, including a roll and a fabric carried by the roll. The fabric includes a plurality of filaments woven together. At least a portion of the filaments have a generally flat machine side base, a generally flat web side face, and a pair of generally flat side walls extending between the base and the face. The portion of the filaments having a generally trapezoidal shaped cross section is defined by the base, the face and the pair of side walls.

An advantage of the present invention is that the fabric has better release properties.

Another advantage is that less release chemicals are needed on the fabric, thereby reducing runnability issues and production costs.

Yet another advantage is that the flat base of the filaments increases the life potential for the fabric.

A further advantage is that the fabric can be used as a TAD fabric.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
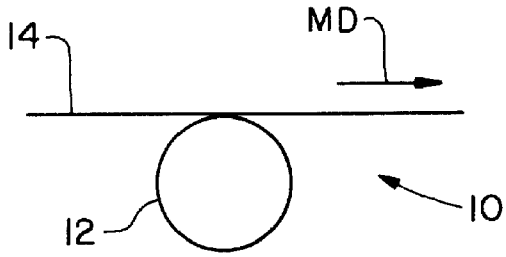
FIG. 1 is a schematic illustration of a portion of a paper machine, including an embodiment of a fabric of the present invention.

Referring now to the drawings, and more particularly to FIG. 1, there is shown a schematic representation of a portion of a paper machine 10, which may generally include a variety of configurations depending upon the application. Paper machine 10 may include a forming section, press section, drying section, etc. each of which typically includes a plurality of rolls 12 (one of which is shown in FIG. 1) carrying a fabric 14. A configuration of roll 12 may vary, depending upon the particular area of use along the running length in machine direction (MD) of paper machine 10. Similarly, fabric 14 of the present invention may also vary in specific filament types, weave patterns, etc., depending upon the particular area of use along the running length in machine direction MD of paper machine 10. In the embodiment shown, fabric 14 of the present invention is assumed to be a TAD fabric.

Figure 2:
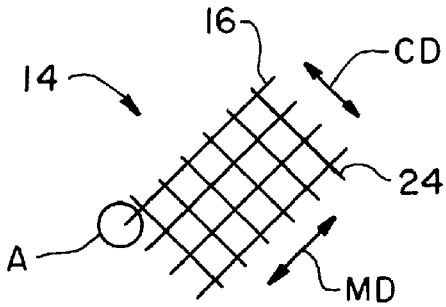
FIG. 2 is a schematic, perspective view of the fabric shown in FIG. 1.

Referring now to FIG. 2, TAD fabric 14 will be described in greater detail. In general, a TAD fabric has two primary characteristics. First, the fabric is constructed to allow a relatively high volumetric flow rate of air through the fabric for drying the fiber web. Further, the TAD fabric is constructed in such a way that the fiber web is drawn into the spaces between the MD filaments and the cross machine direction (CD) filaments, thereby forming pillows in the fiber web upon release with a great degree of bulk and absorbency.

Figure 3:
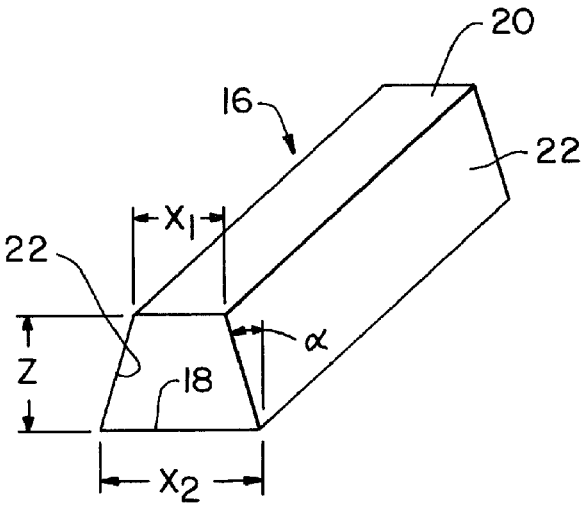
FIG. 3 is an enlarged, perspective view taken at detail A in FIG. 2, showing the cross section of a single filament.

According to an aspect of the present invention, some or all of the MD filaments and/or some or all of the CD filaments are formed with a trapezoidal shaped cross section allowing better release of the fiber web from TAD fabric 14 at the end of the TAD drying process. More particularly, the cross sectional shape of a single filament 16 is shown in FIG. 3, derived from detail A in FIG. 2. Filament 16 has a machine side base 18, a web side face 20, and a pair of side walls 22 extending between base 18 and face 20. Base 18 is positioned adjacent roll 12 of paper machine 10, and face 20 is positioned adjacent to and carries the fiber web. Each of base 18, face 20 and side walls 22 are generally flat to thereby define the generally trapezoidal shaped cross section of filament 16 shown in FIG. 3. Base 18 and face 20 are positioned generally parallel to each other, with face 20 having a width $X_1$ which is shorter than a width $X_2$ of base 18. Side walls 22 are positioned to define a draft angle $\alpha$ with base 18 and face 20 providing better release properties to the fiber web carried thereby. Draft angle $\alpha$ is between approximately 0 to 20°, more preferably is between approximately 1 to 20°, and even more preferably is approximately 10°. Additionally, side walls 22 have a height Z extending between and perpendicular to base 18 and face 20. Height Z of side walls 22 is between approximately 0.75 to 1.05 times the width $X_2$ of base 18, and preferably is approximately 0.90 times the width $X_2$ of base 18.

As indicated above, it is possible to configure fabric 14 such that some or all of MD filaments 16 and/or CD filaments 24 have a trapezoidal shaped cross section as described above. For example, the following combinations of filaments are possible:

Fabric containing 100% of the yarn filaments trapezoidal. Use of trapezoidal filaments on both directions, machine direction (MD) and on cross machine direction (CD).

Use all the MD filaments with standard circumferential shape and apply trapezoidal yarns on the CD filaments.

Use trapezoidal yarns on the MD filaments and use standard circumferential shape on the CD filaments.

CD filaments having more than one type of trapezoidal yarn dimensions.

MD filaments having more than one type of trapezoidal yarn dimensions.

Other configurations are also possible, with the particular configuration of trapezoidal shaped filaments being selected to provide optimum performance for fabric 14.

Figure 4:
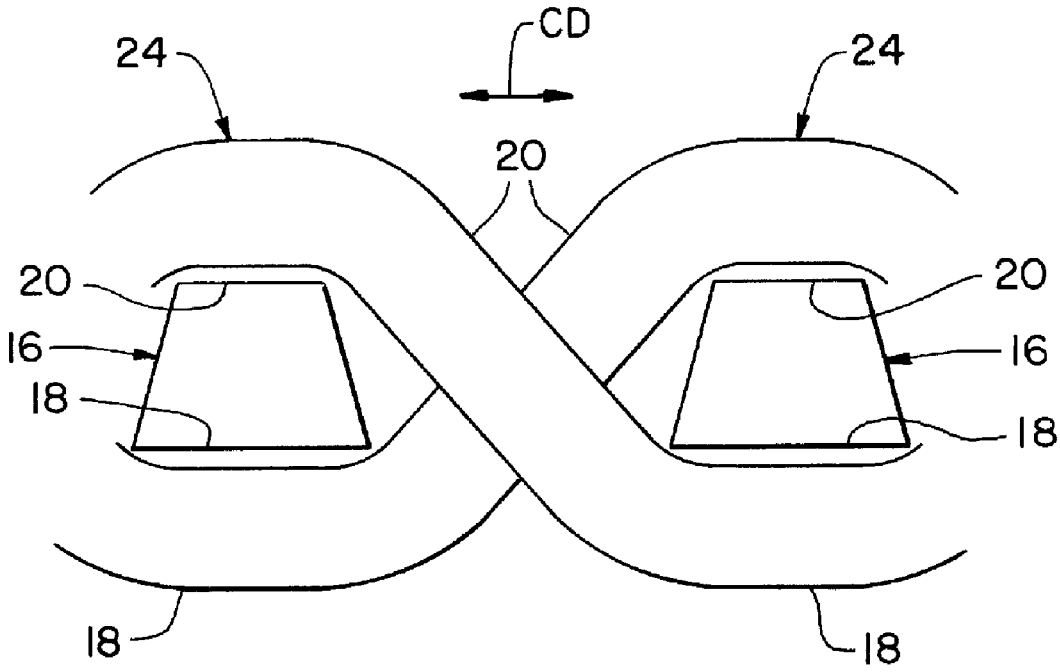
FIG. 4 is an end view showing an exemplary weave pattern of MD filaments and CD filaments.

Referring to FIG. 4, a weave pattern for filaments 16, 24 is shown. CD filaments 24 are also assumed to have a trapezoidal shaped cross section, and thus it will be appreciated that only a single side wall 22 of each CD filament 24 is seen in FIG. 4. By placing the wider base 18 of fabric 14 against roll 12, the runability and service life of fabric 14 is improved.

Figure 5:
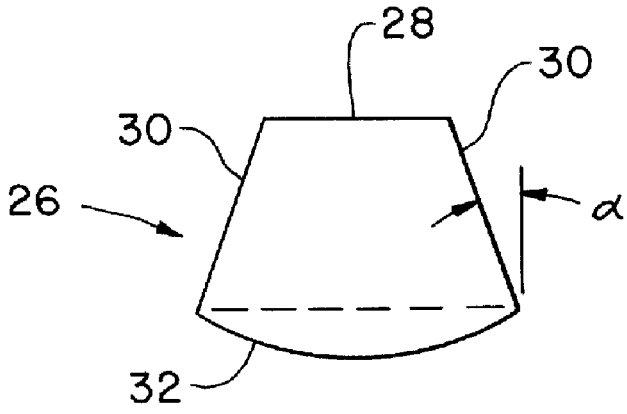
FIG. 5 is an end view of another embodiment of a filament of the present invention.

Referring to FIG. 5, another embodiment of a filament 26 which could possibly be used in the MD or CD directions is shown. Similar to filament 16 shown in FIG. 3, filament 26 shown in FIG. 5 has a face 28 which defines a draft angle $\alpha$ with side walls 30 providing improved release of the fiber web. However, base 32 is not a generally flat surface extending between the apex points of side walls 30 (indicated by the dashed line). Rather, base 32 is a curved surface which could be desirable for some applications against a machine side component of paper machine 10.

During operation, the fiber web is drawn into the spaces between adjacent MD filaments 16 and CD filaments 24 of fabric 14. The flow of air through fabric 14 dries the fiber web with pillows for increased bulk. Release of the fiber web from fabric 14 at the end of the TAD process is improved because of the trapezoidal shaped cross section of MD filaments 16 and/or CD filaments 24.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fabric for use on a paper machine, comprising:

a plurality of filaments woven together, at least a portion of said filaments having a machine side base, a web side face, and a pair of side walls extending between said base and said face, said base having a first width and said face having a second width less than said first width, said portion of said filaments having a generally trapezoidal shaped cross section defined by said face and said pair of side walls, wherein the fabric is a through air drying (TAD) fabric having an air permeability of between approximately 400 cfm and 1000 cfm and said bases of said filaments having a generally trapezoidal shaped cross section lie in a single plane, said side walls of said trapezoidal filaments adjacent to one another defining a diverging flow path between said adjacent trapezoidal filaments through the fabric from said machine side base to said web side face.

2. The fabric of claim 1, wherein each of said base, said face and said pair of side walls are generally flat.

3. The fabric of claim 2, wherein said pair of sidewalls have a height, said height of said sidewalls being between 0.75 to 1.05 times said first width of said base.

4. The fabric of claim 3, wherein said height of said sidewalls is approximately 0.90 times said first width of said base.

5. The fabric of claim 2, wherein said face has a draft angle with each of said sidewalls of between approximately 0 to 20 degrees.

6. The fabric of claim 5, wherein said face has a draft angle with each of said sidewalls of between approximately 1 to 20 degrees.

7. The fabric of claim 6, wherein said face has a draft angle with each of said sidewalls of approximately 10 degrees.

8. The fabric of claim 1, wherein said generally trapezoidal shaped cross section is defined by said base, said face and said pair of side walls.

9. The fabric of claim 1, wherein said fabric includes machine direction (MD) said filaments and cross machine direction (CD) said filaments, at least some of said MD filaments including said trapezoidal shaped cross section.

10. The fabric of claim 9, wherein said MD filaments having said trapezoidal shaped cross section is between 25 to 75 percent of all of said MD filaments.

11. The fabric of claim 9, wherein at least some of said CD filaments include said trapezoidal shaped cross section.

12. The fabric of claim 11, wherein said CD filaments having said trapezoidal shaped cross section is between 25 to 75 percent of all of said CD filaments.

13. The fabric of claim 11, wherein all of said CD filaments include said trapezoidal shaped cross section.

14. The fabric of claim 9, wherein all of said MD filaments include said trapezoidal shaped cross section.

15. The fabric of claim 14, wherein at least some of said CD filaments include said trapezoidal shaped cross section.

16. The fabric of claim 15, wherein said CD filaments having said trapezoidal shaped cross section is between 25 to 75 percent of all of said CD filaments.

17. The fabric of claim 15, wherein all of said CD filaments include said trapezoidal shaped cross section.

18. A fabric for use on a paper machine, comprising:

a plurality of filaments woven together, at least a portion of said filaments having a generally flat machine side base, a generally flat web side face, and a pair of generally flat side walls extending between said base and said face, said base having a first width and said face having a second width less than said first width, said portion of said filaments having a generally trapezoidal shaped cross section defined by said base, said face and said pair of side walls, wherein the fabric is a through air drying (TAD) fabric having an air permeability of between approximately 400 cfm and 1000 cfm, said bases of said filaments having a generally trapezoidal shaped cross section lying in a single plane and said side walls of said trapezoidal filaments adjacent to one another defining a diverging flow path between said adjacent trapezoidal filaments through the fabric from said machine side base to said web side face.

19. The fabric of claim 18, wherein said pair of sidewalls have a height, said height of said sidewalls being between 0.75 to 1.05 times said first width of said base.

20. The fabric of claim 19, wherein said height of said sidewalls is approximately 0.90 times said first width of said base.

21. The fabric of claim 18, wherein said face has a draft angle with each of said sidewalls of between approximately 1 to 20 degrees.

22. The fabric of claim 21, wherein said face has a draft angle with each of said sidewalls of approximately 10 degrees.

23. The fabric of claim 18, wherein said fabric includes machine direction (MD) said filaments and cross machine direction (CD) said filaments, at least some of said MD filaments including said trapezoidal shaped cross section.

24. The fabric of claim 23, wherein said MD filaments having said trapezoidal shaped cross section is between 25 to 75 percent of all of said MD filaments.

25. The fabric of claim 23, wherein at least some of said CD filaments include said trapezoidal shaped cross section.

26. The fabric of claim 25, wherein said CD filaments having said trapezoidal shaped cross section is between 25 to 75 percent of all of said CD filaments.

27. The fabric of claim 25, wherein all of said CD filaments include said trapezoidal shaped cross section.

28. The fabric of claim 23, wherein all of said MD filaments include said trapezoidal shaped cross section.

29. The fabric of claim 28, wherein at least some of said CD filaments include said trapezoidal shaped cross section.

30. The fabric of claim 29, wherein said CD filaments having said trapezoidal shaped cross section is between 25 to 75 percent of all of said CD filaments.

31. The fabric of claim 29, wherein all of said CD filaments include said trapezoidal shaped cross section.

32. A paper machine, comprising:

a roll; and a through air drying (TAD) fabric carried by said roll, said TAD fabric having an air permeability of between approximately 400 cfm and 1000 cfm and including a plurality of filaments woven together, at least a portion of said filaments having a generally flat machine side base, a generally flat web side face, and a pair of generally flat side walls extending between said base and said face, said base having a first width and said face having a second width less than said first width, said portion of said filaments having a generally trapezoidal shaped cross section defined by said base, said face and said pair of side walls, wherein said bases of said filaments having a generally trapezoidal shaped cross section lie in a single plane, said side walls of said trapezoidal filaments adjacent to one another defining a diverging flow path between said adjacent trapezoidal filaments through the fabric from said machine side base to said web side face.

33. The fabric of claim 1, wherein said side walls of said trapezoidal filaments adjacent to one another define a converging flow path between said adjacent trapezoidal filaments through the fabric from web side face to said machine side base.

* * * * *